United States Patent [19]

Maestri

[11] Patent Number: 5,076,481

[45] Date of Patent: Dec. 31, 1991

[54] STAPLER FOR DRIVING METAL STAPLES

[75] Inventor: Elio Maestri, Milano, Italy

[73] Assignee: Romeo Maestri & Figli S.p.A., Milano, Italy

[21] Appl. No.: 488,629

[22] Filed: Mar. 5, 1990

[30] Foreign Application Priority Data

Mar. 3, 1989 [IT] Italy ..... 20677/89[U]

[51] Int. Cl.[5] ..... B25C 5/16

[52] U.S. Cl. ..... 227/126; 227/125

[58] Field of Search ..... 227/125, 126, 127, 128, 227/132

[56] References Cited

U.S. PATENT DOCUMENTS 2,427,156 9/1947 Percoco ..... 227/126

2,569,221 9/1951 Batten ..... 227/126

2,999,241 9/1961 Starr ..... 227/126

*Primary Examiner*—Frank T. Yost

*Assistant Examiner*—Rinaldi Rada

[57] ABSTRACT

A stapler for driving metal staples which are fed through a guide channel to an ejecting channel under the action of a pusher member moved by resilient means on a pair of walls located inside the stapler frame, on said walls there being positioned a strip of metal staples. The inner walls and one side wall of the stapler are shorter than bottom wall of guide channel, so that it is possible to make pusher member to back up until it disengages from inner walls and may be rotated substantially 90° allowing the insertion of a new staples strip once the previous one has been used up.

6 Claims, 5 Drawing Sheets

STAPLER FOR DRIVING METAL STAPLES

BACKGROUND OF THE INVENTION

This invention relates to a stapler for driving metal staples.

Staplers of the above type are already known and it is known as well that these tools are loaded with "strips" of metal staples which are inserted into a suitable feeding channel ending with an ejecting channel. The staple strip is forwarded towards the ejecting channel under the action of a suitable pusher, whereby the metal staples get positioned within the ejecting channel, one at a time, and they are pushed out therefrom by the action of an ejecting blade.

The member which forwards the metal staple strip towards the ejecting channel, i.e. the pusher member mentioned above, is substantially comprised of a slider which is slidably mounted within the metal staples feed channel, and is subjected to the action of an operating spring which is coiled around a small rod having a portion of the slider slidably mounted thereon, said spring being engaged at one end with said portion of the slider, while at the opposite end it abuts against a stapler rear stationary wall.

In staplers of the subject type it is known how highly uncomfortable it is to introduce a new staple strip in the feeding channel once the previous one has been used up. The above operation requires the slider to be taken out of the stapler completely, together with the members associated therewith enabling the slider to slide within the feed channel and controlling said sliding operation.

The requirement to take the pusher member and the members associated therewith completely out of the stapler may cause several problems and, among these, some damages to the slider, for instance when it is accidentally dropped or because of a wrong operation by the user.

Also the operation of reassembling the pusher member on the stapler may prove to be extremely discomfortable once the staple strip has been introduced into the feed channel, and this operation as well may involve wrong moves by the user, which in turn may cause the stapler to jam thereafter.

SUMMARY OF THE INVENTION

Accordingly, it is a principle object of the present invention to provide, a stapler for driving metal staples which obviates the above drawbacks and, according to a basic feature thereof, does not require either the pusher member or the members associated therewith to be taken out of the stapler, while simultaneously providing a unique pusher member handling arrangement whereby a new staple strip may be inserted while the pusher member and the handling members associated therewith remain assembled on the stapler.

BRIEF DESCRIPTION OF THE DRAWINGS

The features as well as the advantages of the stapler according to this invention will become apparent from the following detailed description of a non limiting embodiment thereof, made in reference to the figures of the attached drawings wherein.

DETAILED DESCRIPTION OF THE PREFERRED EMBODIMENT

Figure 1:
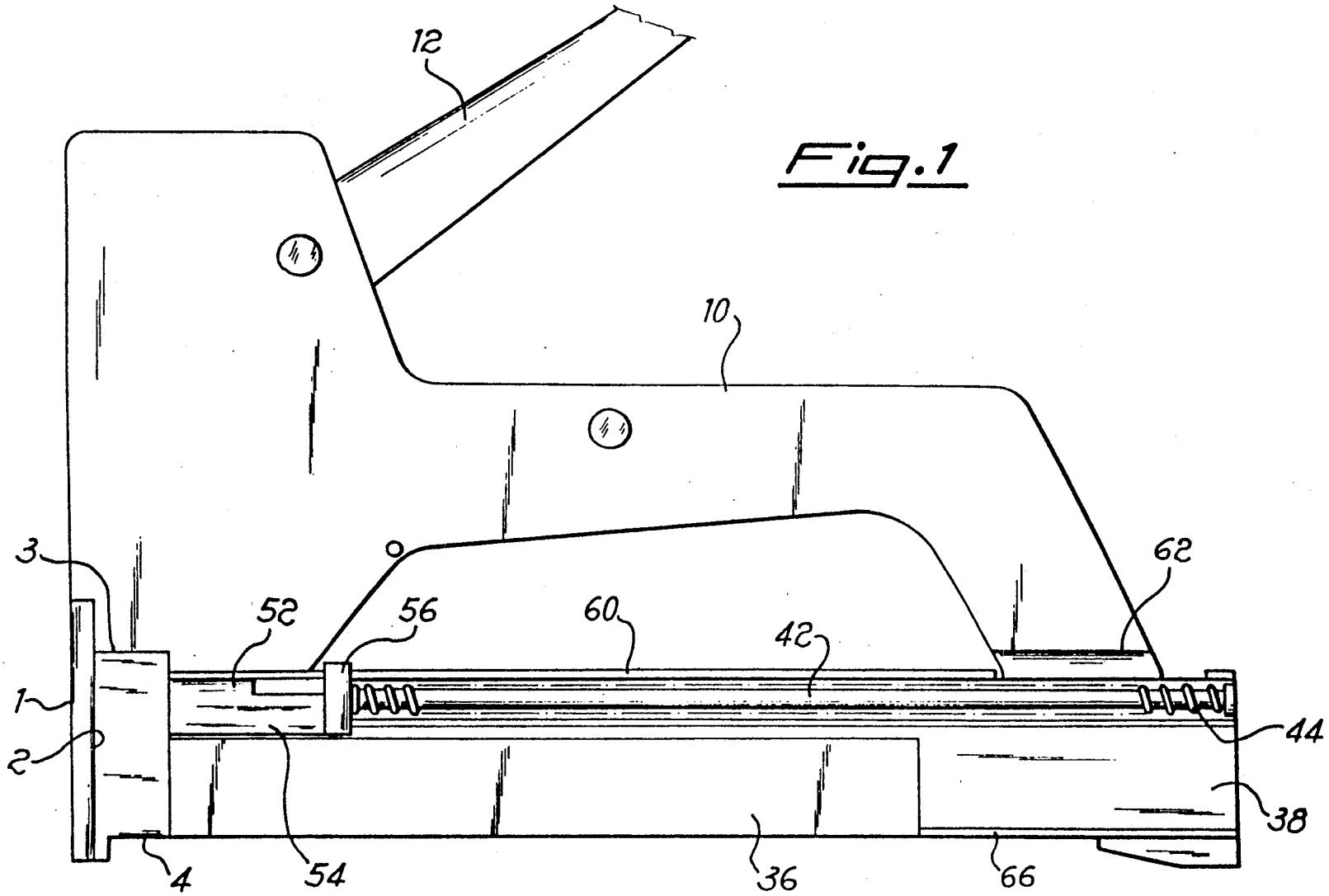
FIG. 1 is a side elevational view of the stapler according to this invention.

The embodiment considered herein is a manually operated one, but the same innovative concept remains applicable for staplers in general, electrically operated, pneumatically operated, and the like.

Referring now to the above figures, the inventive stapler includes, in a known way, a suitably shaped frame 10 including an endwall 1 having an edge 2 and a sidewall 3 having a bottom surface 4, so that the same may be properly gripped and operated, and carrying in the top portion thereof a pivotally mounted control lever 12 whose end located inside frame 10, and shown at 14, engages within a slot 16 of a metal blade 18 comprising the metal staple ejecting member and being, for that purpose, slidably mounted within an ejecting channel.

In a second slot 20 of blade 18 there is also engaged the end of a leaf spring 22, having the opposite end thereof connected to a stationary pivot pin 24. Leaf spring 22 engages, at an intermediate portion thereof, with an inner projection 26 of frame 10, which enables spring 22 to get loaded once control lever 12 is rotated according to arrow F, causing simultaneously ejecting blade 18 to be raised.

Reference number 28 indicates a return spring for returning control lever 12 to the starting position, once a staple has been driven.

The above description is known per se, and no further details will be given herein.

Figure 4:
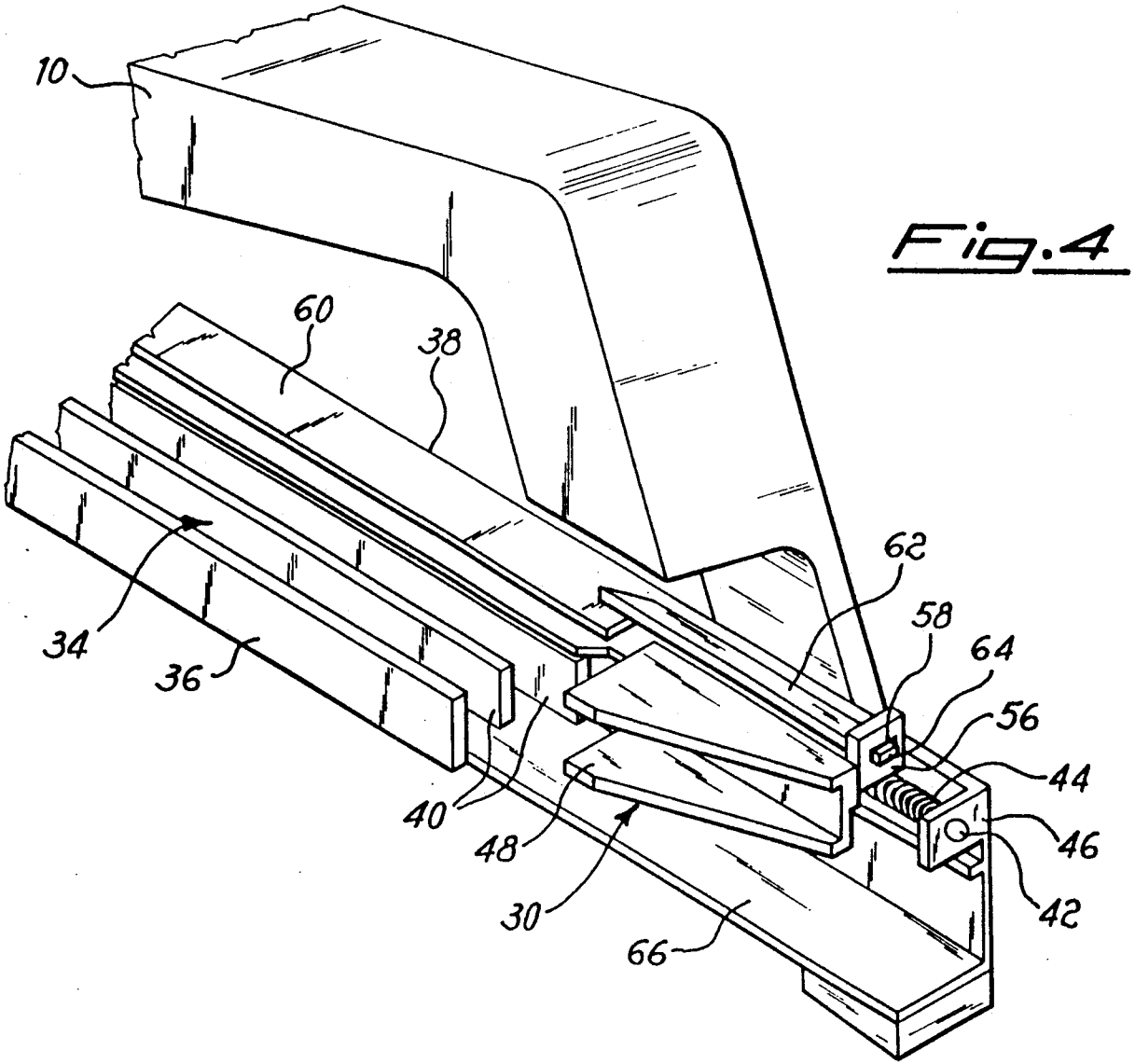
FIG. 4 is a partial perspective view of the stapler according to this invention, which shows the pusher member in the position wherein it enables a new metal staple strip to be loaded.

The inventive stapler further includes a pusher member for a metal staple strip 32, shown in general at 30, which is slidably mounted within a feeding channel, shown in general at 34 in FIG. 4. Channel 34 includes, in a way already known, a pair of outer side walls 36, 38 for guiding strip 32, and a pair of inner walls 40 extending longitudinally of channel 34 and comprising simultaneously a support and a guide for strip 32 towards the ejecting channel.

Pusher member 30, which is described in detail in the following, is slidably supported by a small longitudinal rod 42 having a spring 44 wrapped therearound for providing the forwarding motion of pusher member 30 towards the staple ejecting channel, one end of said spring being engaged with pusher member 30, while the opposite end is in engagement with a stationary rear projection 46 of stapler frame 10.

Pusher 30, provided for instance as a unitary body, comprises essentially a lower substantially U-shaped portion 48 which is applied across inner walls 40 and which comes into engagement, at the front end thereof, with the rear end of strip 32. Portion 48 of pusher member 30 tapers towards the rear portion of the stapler, as it is apparent in particular in FIGS. 2 to 4. Pusher member 30 further includes an upper portion 50 comprising a sleeve 52 slidingly mounted on stationary rod 42, and a projection 54 to be described in the following. Spring 44 has one end thereof engaged with the rear portion of sleeve 52.

Projection 54, which is longer than sleeve 50, has a substantially prism-like shape, with a substantially triangular cross-section having a sloping side, whereby it has a decreasing cross-section starting from sleeve 52. At one end of projection 54 there is provided a substantially rectangularly shaped extension 56 radially positioned relative to projection 54. On extension 56 there is provided an opening 58 which, in the embodiment described herein, has a rectangular cross-section.

Side wall 38 extends above guide channel 34, with a cover wall 60 which extends partially over said channel 34 reaching a position substantially above small rod 42, in order to prevent undesired hand contacts with sleeve 50 and spring 44.

According to this invention, cover wall 60 is interrupted at the rear portion of the stapler, and the rear end 62 thereof is folded upwards, for reasons to be explained in the following. Furthermore, folded end 62 has a projection or tooth 64 whose function will become apparent in the following as well.

According to a further feature of the inventive stapler, both inner walls 40 of guide channel 34 and outer side wall 36 are shorter than bottom wall 66 and more particularly they have such a length as to stop before the position where upper cover wall 60 is interrupted.

From the above it should be apparent that, thanks to the stapler of this invention, loading a new stapler strip is made extremely fast and easy, as it will be explained in the following.

Figure 2:
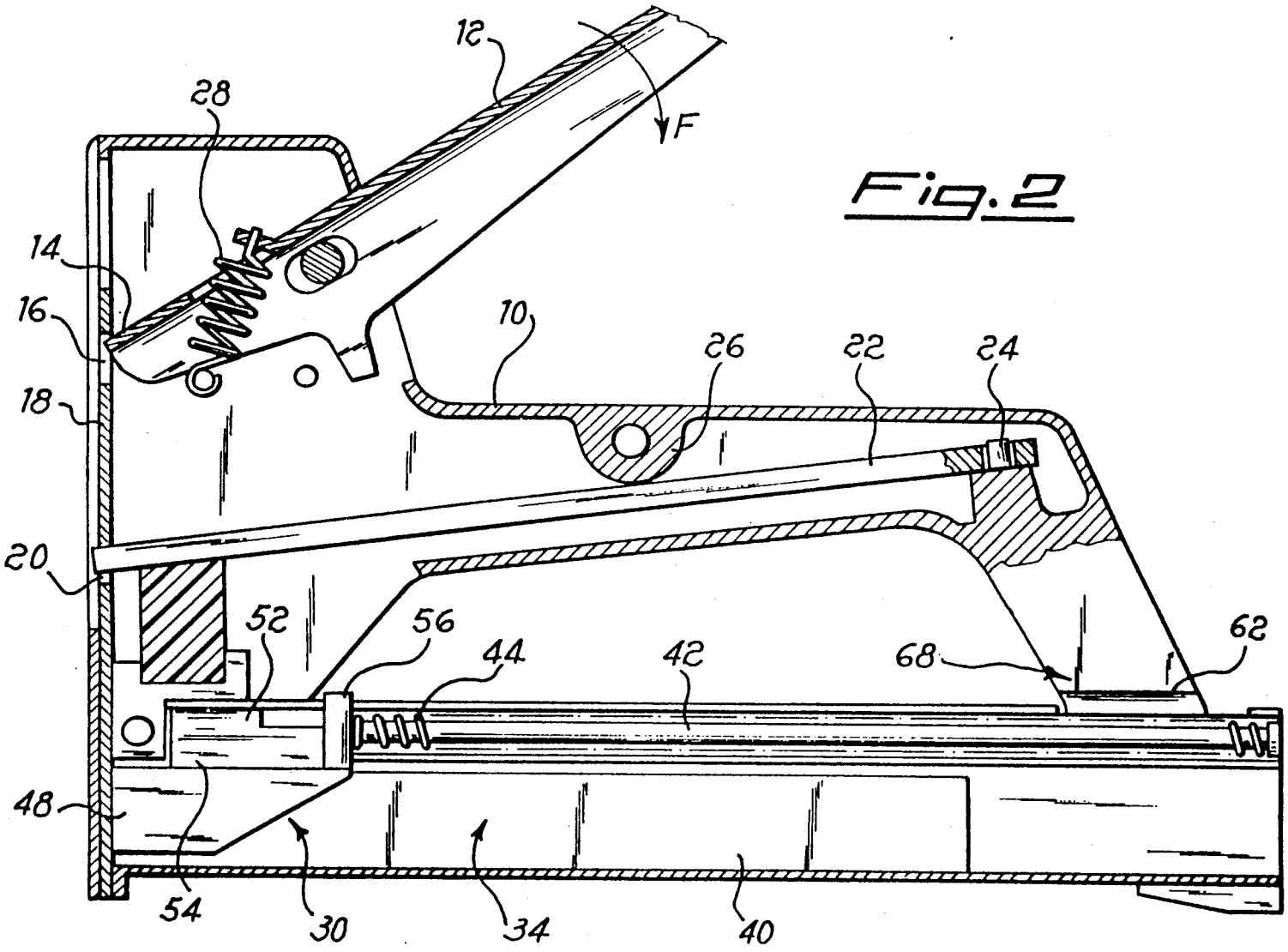
FIG. 2 is a side longitudinal sectional view of the stapler according to this invention.
Figure 3:
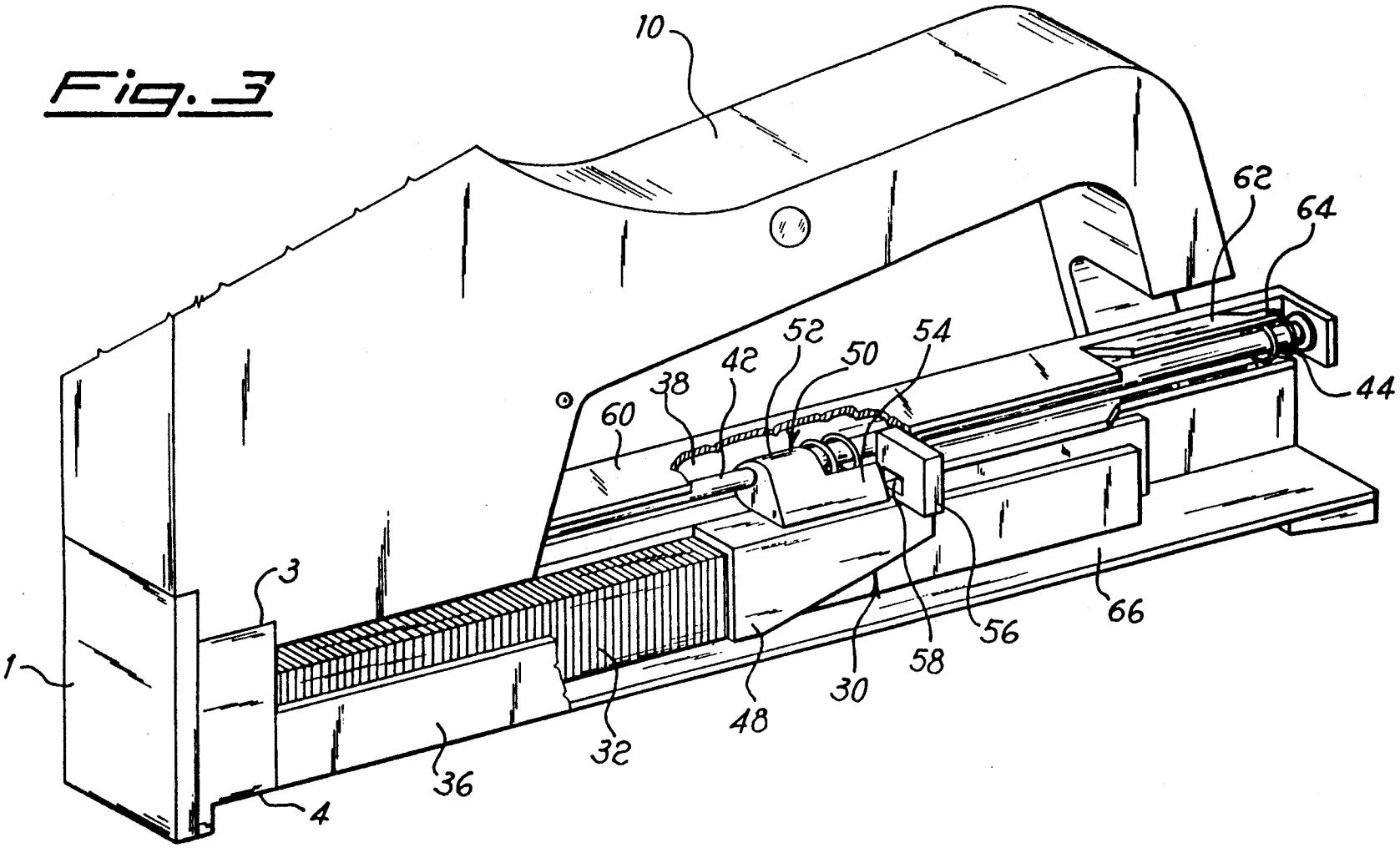
FIG. 3 is a partially cutaway perspective view, which shows the pusher member in the operating position.

Once a staple strip 32 has been used up, as it is shown in FIG. 2, it is enough, by operating on extension 56 of pusher 30 located substantially outside stapler frame 10, to move pusher 30 back until portion 48 thereof comes out of engagement with inner walls 40, in which condition pusher 30 may be controlled to rotate around small rod 42 until it reaches the position shown in FIG. 4. Rotation is made possible owing both to the reduced length of inner walls 40 and of side wall 36, and to the slope of the rear end of cover wall 60. Concerning the above it should be noted that the slope of the front face of projection 54 substantially matches that of said end 62 of wall 60, whereby an abutment is provided which makes it easier and guides the insertion of tooth 64 within opening 58.

Figure 5:
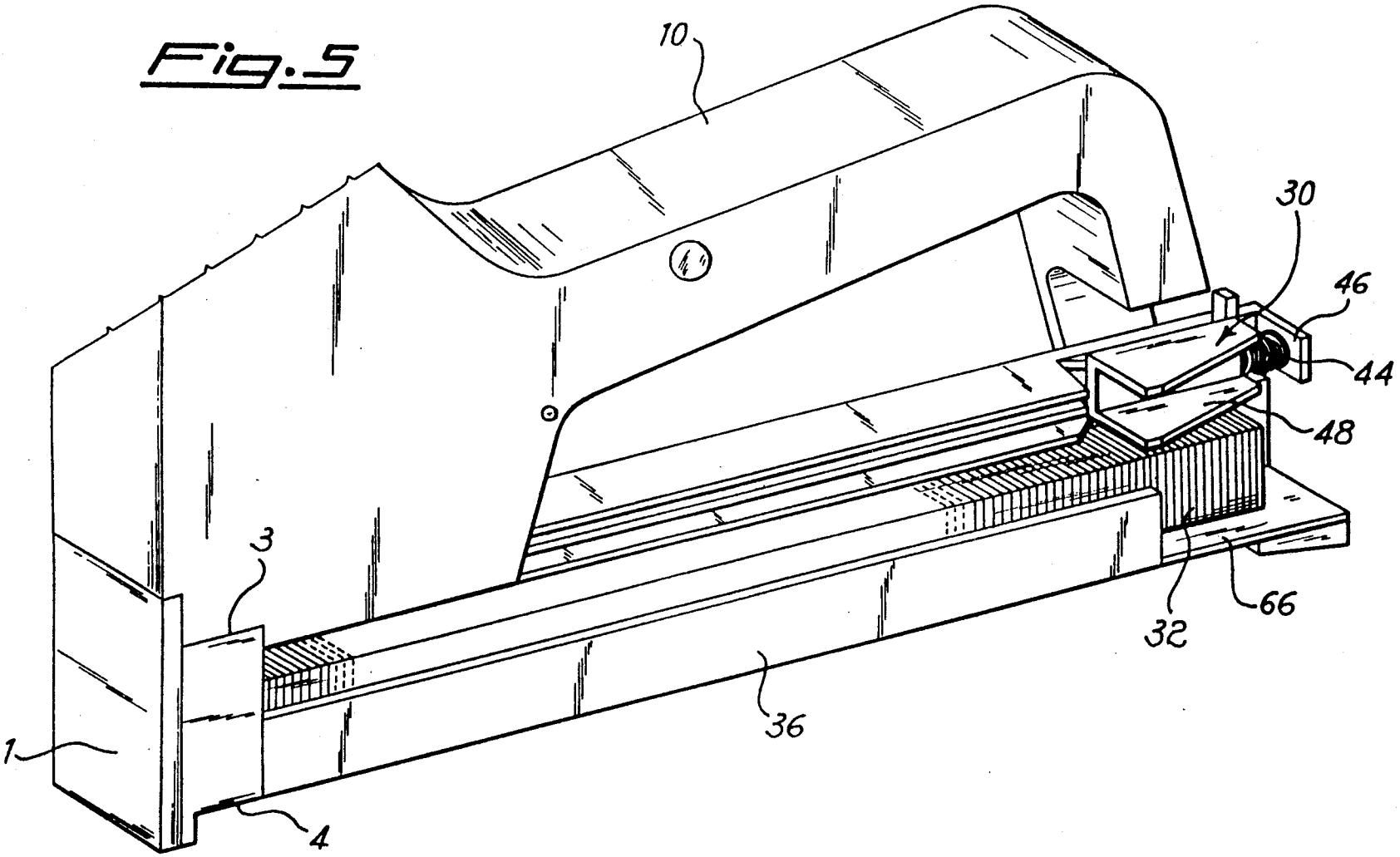
FIG. 5 is a perspective view of the stapler which shows the step of loading a new staple strip.

It should also be noted that, when pusher 30 is in the position rotated substantially 90°, as it is shown in FIGS. 4 and 5, the side which is now located downwards remains located higher than the height of inner walls 40, whereby the rear loading of a new staple 32 is made possible.

Once the strip has been introduced in guide channel 34 projection 56 is operated again causing the latter to disengage from tooth 64 and pusher 30 to be subsequently rotated all the way to the starting position, wherein it can be positioned again on inner walls 40 and it can perform again its pushing action on strip 32.

It should eventually be apparent that variations and/or modifications may be made to the stapler according to this invention, without exceeding the scope of protection of said invention.

What we claim is:

1. A stapler for driving metal staples, which stapler including a frame, a guide channel, an ejecting channel, a pusher member and resilient means, said staples being fed through said guide channel to said ejecting channel under the action of said pusher member controlled by said resilient means, said pusher member being moved by said resilient means on a pair of inner walls located within the stapler frame, on said inner walls there being positioned at least a strip of metal staples, comprising said stapler including a staple locking member having a longitudinal axis, inner walls and side walls, and said guide channel including a bottom wall, said inner walls and one of said side walls having a length shorter than said bottom wall of said guide channel and said pusher member having a longitudinal axis separate and parallel to said longitudinal axis of said staple locking member, said pusher member including an extension, integral thereto, located and projecting outside of said stapler frame, said extension being adapted to retract said pusher member until it disengages from said inner walls of said guide channel and said pusher member and said extension being rotatable substantially 90° about said longitudinal axis of said pusher element to permit the strip of metal staples to be fed thereabout whereby said extension engages said stapler locking member which is adapted to temporarily retain said pusher member in the rotated position, said guide channel including an upper cover wall having an upward sloping rear end wherein said rotation of the pusher member is allowed as well by the upward sloping rear end of a upper cover wall of said guide channel.

2. The stapler of claim 1, wherein said pusher member includes an upper portion which substantially comprises a sleeve slidably mounted on a small stationary rod carrying said resilient means, said resilient means is engaged with said sleeve, and a projection longer than said sleeve and provided, at one end thereof, with said extension projecting outside said stapler frame.

3. The stapler of claim 2, wherein said cover wall includes said upward sloping rear end and said extension has an opening, and a tooth provided on said upward sloping rear end of said cover wall which may engage therein, when said pusher member has been brought to the rotated position.

4. The stapler of claim 2, wherein said projection has a face which can be seen and which has a decreasing cross-section starting from said sleeve.

5. The stapler according to claim 4, wherein said cover wall of said guide channel has an end and the face of said projection has a slope which can be seen is substantially the same as that of the end of said cover wall of said guide channel.

6. The stapler of claim 1, said pusher having a side and wherein when said pusher member is in the rotated position, the side of said pusher is located downwards and said side is higher than the height of said inner walls whereon the metal staples are fed.

* * * * *